US005657578A

United States Patent [19]

Thompson

[11] Patent Number: 5,657,578

[45] Date of Patent: Aug. 19, 1997

[54] EASY OUT FIRE ESCAPE WINDOW GATE

[76] Inventor: Robert Thompson, 807 E. 42nd. St., Brooklyn, N.Y. 11210

[21] Appl. No.: 559,923

[22] Filed: Nov. 17, 1995

[51] Int. Cl.[6] ..... E05B 65/10

[52] U.S. Cl. ..... 49/141; 49/50; 49/395

[58] Field of Search ..... 49/366, 50, 141, 49/395; 292/38

[56] References Cited

U.S. PATENT DOCUMENTS

| | | | |
|---|---|---|---|
| 912,379 | 2/1909 | Jackson | 292/38 |
| 1,552,690 | 9/1925 | Frantz | 292/38 X |
| 3,617,080 | 11/1971 | Miller | 292/38 |
| 4,677,789 | 7/1987 | Merry | 49/141 X |
| 5,289,655 | 3/1994 | Marmora et al. | 49/141 |

*Primary Examiner*—Kenneth J. Dorner
*Assistant Examiner*—Jerry Redman
*Attorney, Agent, or Firm*—Michael I. Kroll

[57] ABSTRACT

An easy out fire escape window gate comprising a gate frame mounted to a window frame of a window on an inner side of an exterior wall of a building. A pair of protective shutters are provided. Components are for connecting opposite sides of the protective shutters to opposite sides of the gate frame. The protective shutters can swing to an open position and a closed position. A structure is for locking the protective shutters to the gate frame in the closed position, to prevent an entry through the window from the exterior of the building to reduce burglaries. A facility is for quickly unlocking the protective shutters from the gate frame. The protective shutters can go into the opened position, to allow people within the building to safely exit through the window during a fire.

6 Claims, 3 Drawing Sheets

Fig. 5
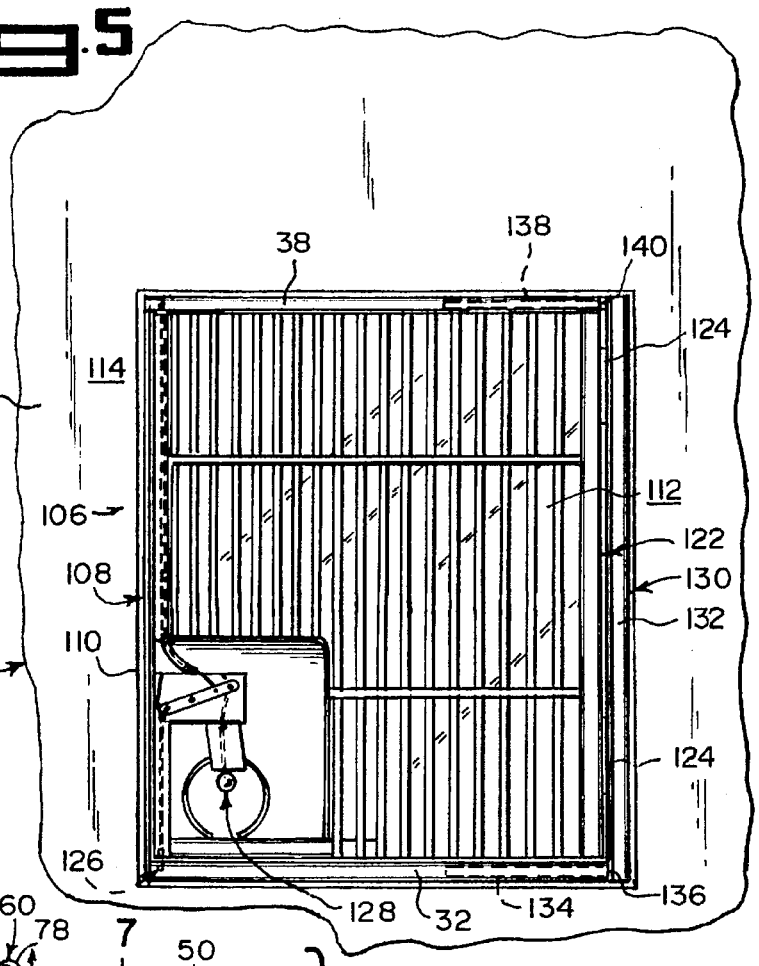
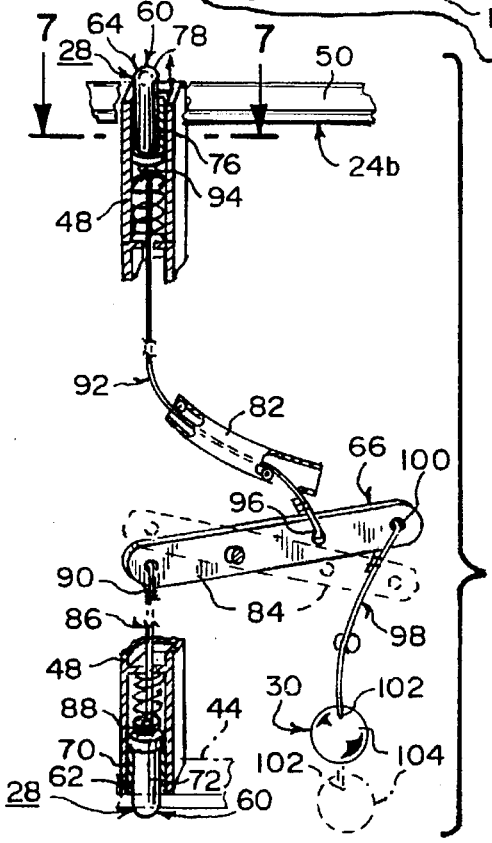
Fig. 6
Fig. 7
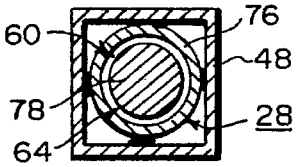

EASY OUT FIRE ESCAPE WINDOW GATE

BACKGROUND OF THE INVENTION

1. Field of the Invention

The instant invention relates generally to window guards and more specifically it relates to an easy out fire escape window gate.

2. Description of the Prior Art

Numerous window guards have been provided in prior art that are adapted to cover windows, to prevent the unauthorized entry through the windows of burglars and other people not wanted. While these units may be suitable for the particular purpose to which they address, they would not be as suitable for the purposes of the present invention as heretofore described.

SUMMARY OF THE INVENTION

A primary object of the present invention is to provide an easy out fire escape window gate that will overcome the shortcomings of the prior art devices.

Another object is to provide an easy out fire escape window gate that is a protective shutter, which will cover and lock onto the interior side of a window frame, to prevent entry through the window from the exterior of the building to reduce burglaries.

An additional object is to provide an easy out fire escape window gate, in which the protective shutter can be opened quickly, to allow any people within the building to safely exit through the window in the building during a fire.

A further object is to provide an easy out fire escape window gate that is simple and easy to use.

A still further object is to provide an easy out fire escape window gate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 a perspective view of a portion of an inner side of an exterior wall of a building, showing a first embodiment of the instant invention installed into a window frame with the two protective shutters locked closed.

Figure 4:
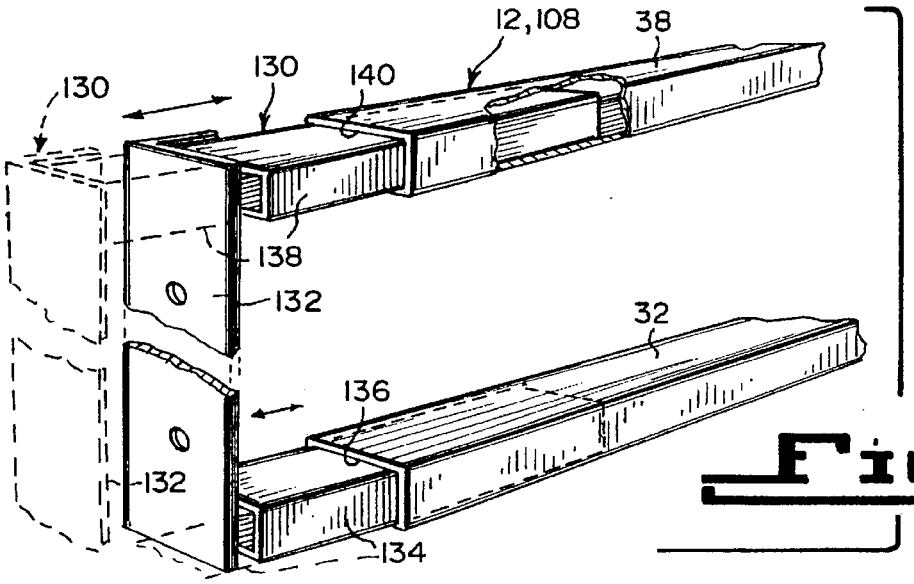

FIG. 4 a perspective view with parts broken away and in section, showing a frame expander inserted into the lintel and sill of the gate frame of the first embodiment.

FIG. 5 is an elevational view with parts broken away of a second embodiment of the instant invention with the protective shutter locked closed and the frame expander inserted into the lintel and sill of the gate frame.

FIG. 6 is a perspective view with parts broken away and in section showing the various parts of the locking mechanism.

FIG. 7 is a cross sectional view taken along line 7—7 in FIG. 6.

Similar reference characters denote corresponding features consistently throughout the attached drawings.

DETAILED DESCRIPTION OF THE PREFERRED EMBODIMENTS

Figure 1:
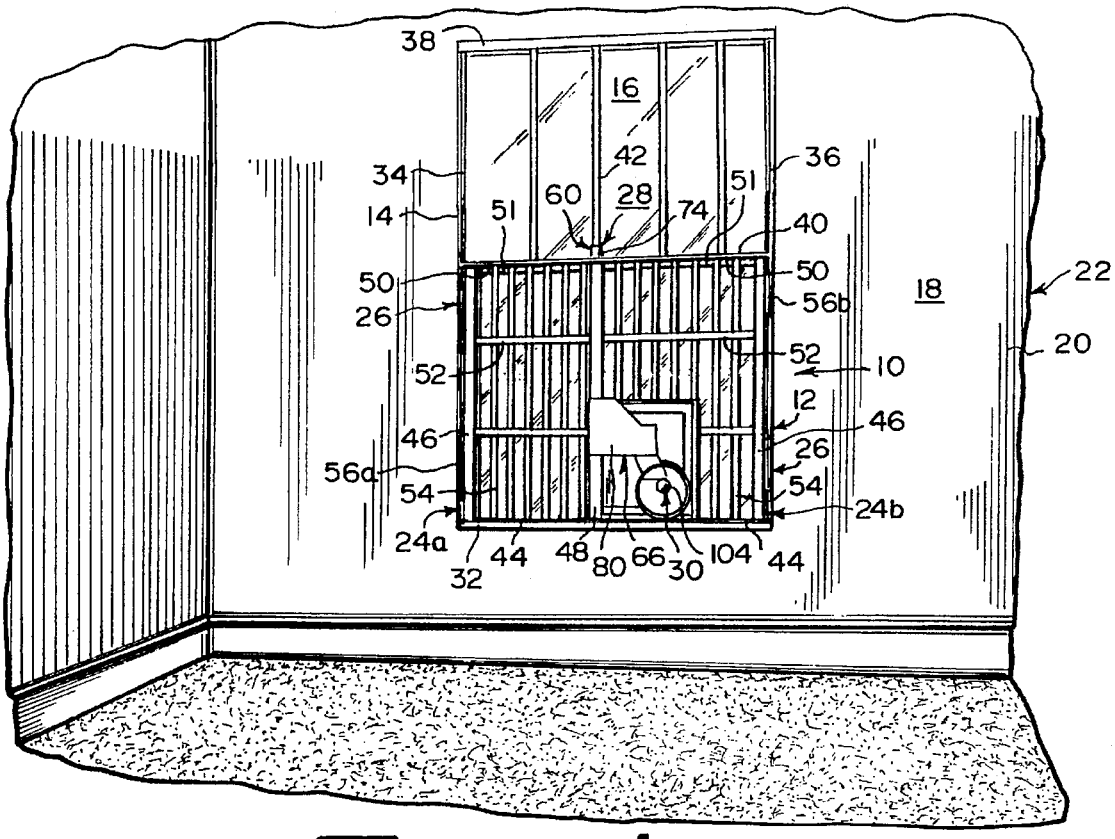
Figure 2:
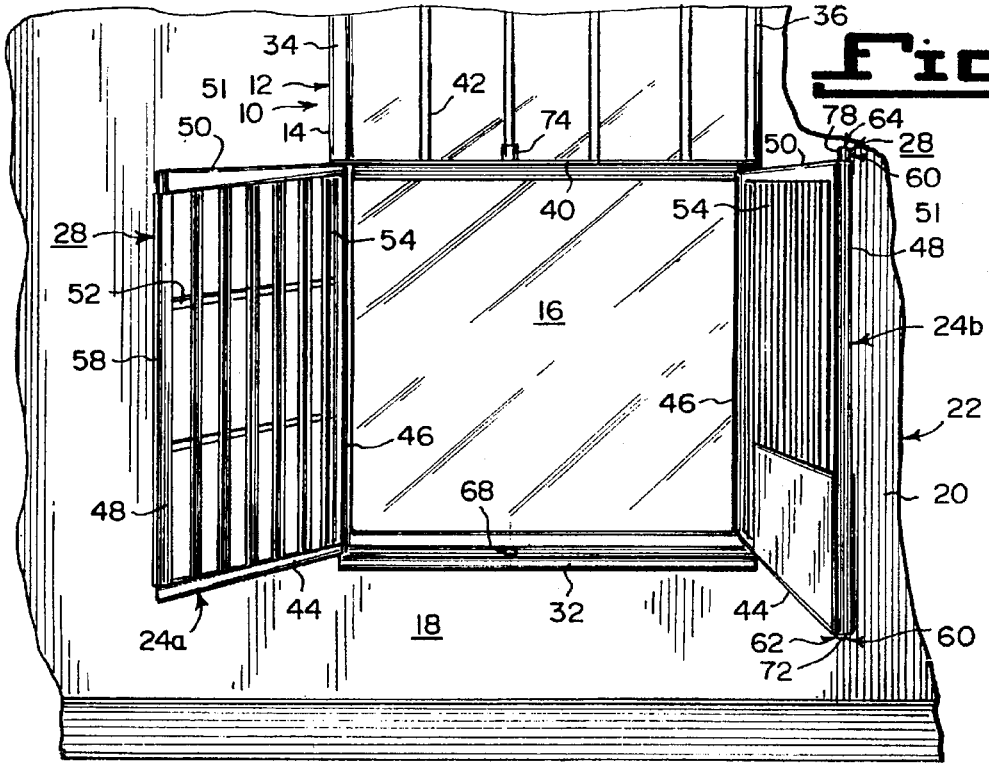
FIG. 2 is an enlarged perspective view of a portion of the inner side of the exterior wall of the building, showing the two protective shutters of the first embodiment opened.
Figure 3:
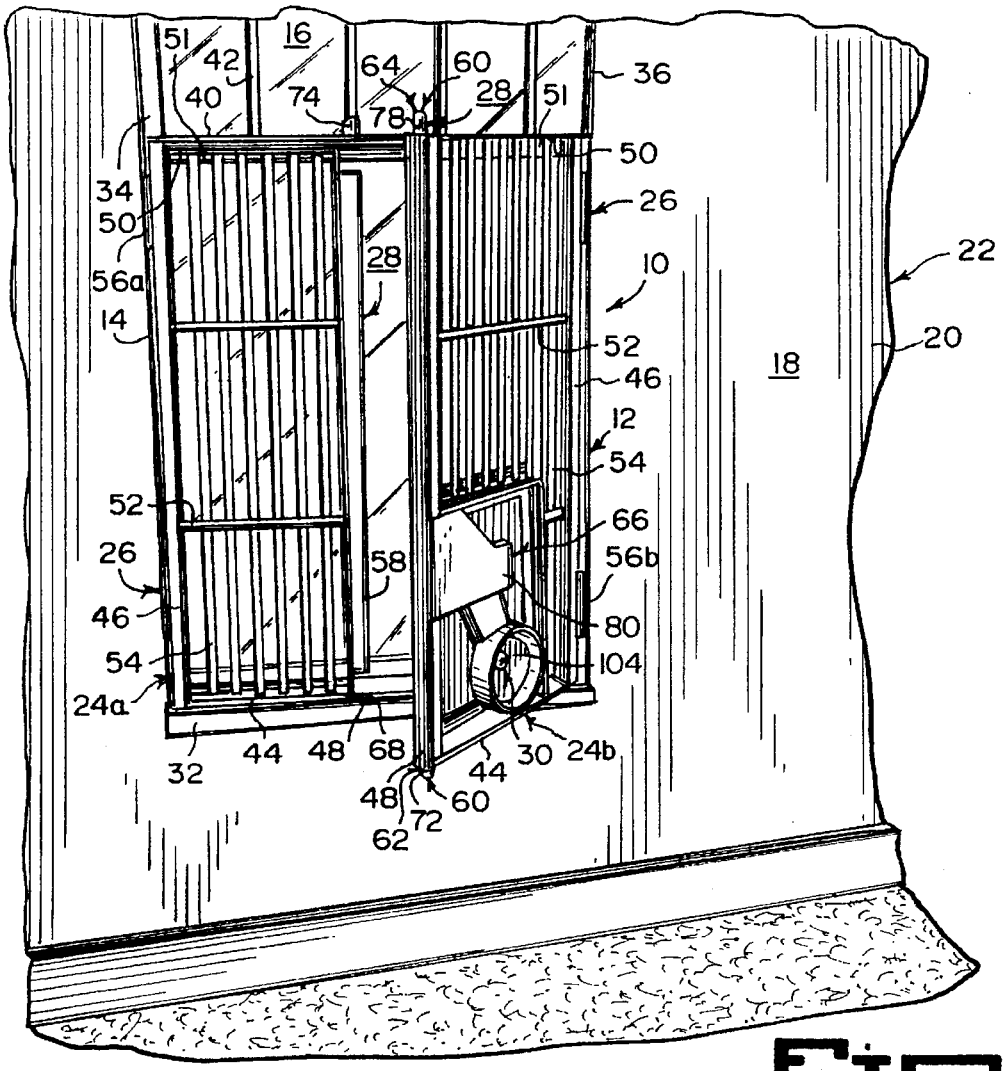
FIG. 3 is an enlarged perspective view of a portion of the inner side of the exterior wall of the building, showing one of the protective shutters of the first embodiment partially opened.

Turning now descriptively to the drawings, in which similar reference characters denote similar elements throughout the several views, FIGS. 1 through 3 illustrate an easy out fire escape window gate 10, comprising a gate frame 12 mounted to a window frame 14 of a window 16 on an inner side 18 of an exterior wall 20 of a building 22. A pair of protective shutters 24*a*, 24*b* are provided. Components 26 are for connecting opposite sides of the protective shutters 24*a*, 24*b* to opposite sides of the gate frame 12. The protective shutters 24*a*, 24*b* can swing to an open position and a closed position. A structure 28 is for locking the protective shutters 24*a*, 24*b* to the gate frame 12 in the closed position, to prevent an entry through the window 16 from the exterior of the building 22 to reduce burglaries. A facility 30 is for quickly unlocking the protective shutters 24*a*, 24*b* from the gate frame 12. The protective shutters 24*a*, 24*b* can go into the opened position, to allow people within the building 22 to safely exit through the window 16 during a fire.

The gate frame 12 consists of a sill 32. A left jamb 34 is affixed to and extends upwardly from the sill 32. A right jamb 36 is affixed to and extends upwardly from the sill 32. A lintel 38 affixed between the left jamb 34 and the right jamb 36 extends parallel over the sill 32. An intermediate horizontal gate frame bar 40 is affixed between the left jamb 34 and the right jamb 36. A plurality of spaced apart vertical gate frame bars 42 are affixed between the lintel 38 and the intermediate horizontal gate frame bar 40.

Each protective shutter 24*a*, 24*b* includes a bottom rail 44. A butte stile 46 is affixed to and extends upwardly from the bottom rail 44. A lock stile 48 is affixed to and extends upwardly from the bottom rail 44. A top rail 50 having a flange 51 affixed between the butte stile 46 and the lock stile 48 and extends parallel over the bottom rail 44. A plurality of spaced apart horizontal shutter bars 52 are affixed between the butte stile 46 and the lock stile 48. A plurality of spaced apart vertical shutter bars 54 are affixed between the bottom rail 44 and the flange 51 of the top rail 50.

The connecting components 26 consist of a plurality of hinges 56*a* between the left jamb 34 of the gate frame 12 and the butte stile 46 of the first protective shutter 24*a*. A plurality of hinges 56*b* are between the right jamb 36 of the gate frame 12 and the butte stile 46 of the second protective shutter 24*b*.

The locking structure 28 includes an elongated vertical flange 58 connected to the lock stile 48 of the first protective shutter 24*a*. A locking mechanism 60 is connected to the lock stile 48 of the second protective shutter 24*b*. When the first protective shutter 24*a* goes into the closed position and the second protective shutter 24*b* goes into the closed position, the elongated vertical flange 58 will fit behind the lock stile 48 of the second protective shutter 24*b*. The locking mechanism 60 in the lock stile 48 of the second protective shutter **24*b* will engage with the sill 32 and the intermediate horizontal gate frame bar 40, to keep the first protective shutter 24*a* and the second protective shutter 24*b*** in the closed position.

The locking mechanism 60 contains a bottom slam bolt assembly 62 mounted within a bottom end of the lock stile 48 of the second protective shutter **24*b*. A top slam bolt assembly 64 is mounted within a top end of the lock stile 48 of the second protective shutter 24*b***.

The unlocking facility 30 includes a release mechanism 66 connected to the lock stile 48 of the second protective shutter **24*b* and is coupled to the bottom slam bolt assembly 62 and the top slam bolt assembly 64. When the release mechanism 66 is manually activated, the bottom slam bolt assembly 62 and the top slam bolt assembly 64 will be disengaged, to allow the second protective shutter 24*b* to go into the opened position and the first protective shutter 24*a*** to go into the opened position.

The bottom slam bolt assembly 62, as best seen in FIGS. 2 and 6, consists of the sill 32 of the gate frame 12 having a socket 68 therein. A sleeve 70 is affixed into the bottom end of the lock stile 48 of the second protective shutter **24*b*. A bottom spring biased slide bolt 72 is carried within the sleeve 70, to normally extend outwardly from the sleeve 70, so as to enter the socket 68 in the sill 32**.

The top slam bolt assembly 64, as best seen in FIGS. 2, 6 and 7, includes the intermediate horizontal gate frame bar 40 of the gate frame 12 having a socket 74 therein. A sleeve 76 is affixed into the top end of the lock stile 48 of the second protective shutter **24*b*. A top spring biased slide bolt 78 is carried within the sleeve 76 to normally extend outwardly from the sleeve 76, so as to enter the socket 74 in the intermediate horizontal gate frame bar 40**.

The release mechanism 66, as best seen in FIGS. 3 and 6, comprises a housing 80 having a cable guide 82 connected to the lock stile 48 of the second protective shutter **24*b*. An actuator lever 84 is pivotally carried within the housing 80. A first cable 86 extending down through the lock stile 48, has a first end 88 connected to the bottom spring biased slide bolt 72 of the bottom slam bolt assembly 62 and a second end 90 connected to one side of the actuator lever 84. A second cable 92 extending up through the cable guide 82 and the lock stile 48, has a first end 94 connected to the top spring biased slide bolt 78 of the top slam bolt assembly 64 and a second end 96 connected to an opposite side of the actuator lever 84. A third cable 98 has a first end 100 connected to the opposite side of the actuator lever 84 and a second end 102 extending down and out of the housing 80. A knob 104 is affixed to the second end 102 of the third cable 98. When the knob 104 is pulled downwardly, the bottom spring biased slide bolt 72 and the top spring biased slide bolt 78 will disengage from the respective sockets 68 and 74**.

FIG. 5 shows a modified easy out fire escape window gate 106, comprising a gate frame 108 mounted to a window frame 110 of a window 112 on an inner side 114 of an exterior wall 116 of a building 120. A protective shutter 122 is provided. Components 124 are for connecting one side of the protective shutter 122 to one side of the gate frame 108. The protective shutter 122 can swing to an open position and to a closed position. A structure 126 is for locking the protective shutter 122 to the gate frame 108 in the closed position, to prevent an entry through the window 112 from the exterior of the building 120 to reduce burglaries. A facility 128 is for quickly unlocking the protective shutter 122 from the gate frame 108. The protective shutter 122 can go into the open position, to allow people within the building 120 to safely exit through the window 112 during a fire. The locking structure 126 and the unlocking facility 128 is identical to the locking structure 28 and the unlocking facility 30 in the easy out fire escape window gate 10.

A frame extender 130 is shown in FIGS. 4 and 5, and consists of an elongated vertical L-shaped channel member 132. A first arm 134 is affixed at one end and at a right angle to a lower end of the channel member 132, to slide fit into an open end 136 of the sill 32 of the gate frame 12 or 108. A second arm 138 is affixed at one end and at a right angle to an upper end of the channel member 132, to slide fit into an open end 140 of the lintel 38 of the gate frame 12 or 108.

The frame extender 130 compensates for different width window frames. There will be no distortion of alignment of the bottom spring biased slide bolt 72 to the socket 68 and the top spring biased slide bolt 78 to the socket 74. The frame extender 130 allows for a good fit regardless of window distortion or allowance necessary for installation.

LIST OF REFERENCE NUMBERS

10 easy out fire escape window gate
12 gate frame of 10
14 window frame of 16
16 window in 14
18 inner side of 20
20 exterior wall of 22
22 building
**24*a* first protective shutter of 10**
**24*b* second protective shutter of 10**
26 connecting component
28 locking structure
30 unlocking facility
32 sill of 12 and 108
34 left jamb of 12
36 right jamb of 12
38 lintel of 12 and 108
40 intermediate horizontal gate frame bar of 12
42 vertical gate frame bar of 12
44 bottom rail of **24*a*, 24*b***
46 butte stile of **24*a*, 24*b***
48 lock stile of **24*a*, 24*b***
50 top rail of **24*a*, 24*b***
51 flange of 50
52 horizontal shutter bar of **24*a*, 24*b***
54 vertical shutter bar of **24*a*, 24*b***
**56*a* hinge of 26 between 34 and 46**
**56*b* hinge of 26 between 36 and 46**
58 elongated vertical flange of 28
60 locking mechanism of 28
62 bottom slam bolt assembly of 60
64 top slam bolt assembly of 60
66 release mechanism for 30
68 socket in 32
70 sleeve of 62
72 bottom spring biased slide bolt in 70
74 socket in 40
76 sleeve of 64
78 top spring biased slide bolt in 76

80 housing of 66
82 cable guide in 80
84 actuator lever in 80
86 first cable of 66
88 first end of 86
90 second end of 86
92 second cable of 66
94 first end of 92
96 second end of 92
98 third cable of 66
100 first end of 98
102 second end of 98
104 knob on 102
106 modified easy out fire escape window gate
108 gate frame of 106
110 window frame of 112
112 window in 110
114 inner side of 116
116 exterior wall of 120
120 building
122 protective shutter
124 connecting component
126 locking structure
128 unlocking facility
130 frame extender
132 elongated vertical L-shaped channel member of 130
134 first arm of 130
136 open end of 32
138 second arm of 130
140 open end of 38

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An easy out fire escape window gate comprising:

a) a gate frame mounted to a window frame of a window on an inner side of an exterior wall of a building, said gate frame including:
   i) a sill;
   ii) a left jamb affixed to and extending upwardly from said sill;
   iii) a right jamb affixed to and extending upwardly from said sill;
   iv) a lintel affixed between said left jamb and said right jamb extending parallel over said sill;
   v) an intermediate horizontal gate frame bar affixed between said left jamb and said right jamb; and
   vi) a plurality of spaced apart vertical gate frame bars affixed between said lintel and said intermediate horizontal gate frame bar;

b) first and second protective shutters, both of which include:
   i) a bottom rail;
   ii) a butte stile affixed to and extending upwardly from said bottom rail;
   iii) a lock stile affixed to and extending upwardly from said bottom rail;
   iv) a top rail having a flange affixed between said butte stile and said lock stile, extending parallel over said bottom rail;
   v) a plurality of spaced apart horizontal shutter bars affixed between said butte stile and said lock stile; and
   vi) a plurality of spaced apart vertical shutter bars affixed between said bottom rail and said flange of said top rail;

c) means for connecting opposite sides of said protective shutters to opposite sides of said gate frame, so that said protective shutters can swing to an open position and a closed position;

d) means for locking said protective shutters to said gate frame in the closed position, to prevent an entry through the window from the exterior of the building to reduce burglaries, said locking means including:
   i) an elongated vertical flange connected to said lock stile of said first protective shutter: and
   ii) a locking mechanism connected to said lock stile of said second protective shutter, so that when said first protective shutter goes into the closed position and said second protective shutter goes into the closed position, said elongated vertical flange will fit behind said lock stile of said second protective shutter, while said locking mechanism in said lock stile of said second protective shutter will engage with said sill and said intermediate horizontal gate frame bar, to keep said first protective shutter and said second protective shutter in the closed position, said locking mechanism including: a bottom slam bolt assembly mounted within a bottom end of said lock stile of said second protective shutter; and a top slam bolt assembly mounted within a top end of said lock stile of said second protective shutter, said top slam bolt assembly including:
      A) a socket in said intermediate horizontal gate frame bar of said gate;
      B) a sleeve affixed into said top end of said lock stile of said second protective shutter; and
      C) a top spring biased slide bolt carried within said sleeve to normally extend outwardly from said sleeve, so as to enter said socket in said intermediate horizontal gate frame bar; and e) means for quickly unlocking said protective shutters from said gate frame, so that said protective shutters can go into the opened position to allow people within the building to safely exit through the window during a fire, said unlocking means including a release mechanism connected to said lock stile of said second protective shutter and coupled to said bottom slam bolt assembly and said top slam bolt assembly, so that when said release mechanism is manually activated, said bottom slam bolt assembly and said top slam bolt assembly will be disengaged to allow said second protective shutter to go into the opened position and said first protective shutter to go into the opened position, said release mechanism including:

i) a housing having a cable guide connected to said lock stile of said second protective shutter;

ii) an actuator lever pivotally carried within said housing;

iii) a first cable extending down through said lock stile, having a first end connected to said bottom spring biased slide bolt of said bottom slam bolt assembly and a second end connected to one side of said actuator lever;

iv) a second cable extending up through said cable guide and said lock stile, having a first end connected to said top spring biased slide bolt of said top slam bolt assembly and a second end connected to an opposite side of said actuator lever;

v) a third cable having a first end connected to the opposite side of said actuator lever and a second end extending down and out of said housing; and vi) a knob affixed to said second end of said third cable, so that when said knob is pulled downwardly, said bottom spring biased slide bolt and and said top spring biased slide bolt will disengage from said respective sockets.

2. An easy out fire escape window gate as recited in claim 1, wherein said connecting means includes:

a) a plurality of hinges between said left jamb of said gate frame and said butte stile of said first protective shutter; and b) a plurality of hinges between said right jamb of said gate frame and said butte stile of said second protective shutter.

3. An easy out fire escape window gate as recited in claim 2, wherein said bottom slam bolt assembly includes:

a) said sill of said gate frame having a socket therein;

b) a sleeve affixed into said bottom end of said lock stile of said second protective shutter; and c) a bottom spring biased slide bolt carried within said sleeve to normally extend outwardly from said sleeve, so as to enter said socket in said sill.

4. An easy out fire escape window gate as recited in claim 3, further including a frame extender consisting of:

a) an elongated vertical L-shaped channel member;

b) a first arm affixed at one end and at a right angle to a lower end of said channel member, to slide fit into an open end of said sill of said gate frame; and c) a second arm affixed at one end and at a right angle to an upper end of said channel member, to slide fit into an open end of said lintel of said gate frame.

5. An easy out fire escape window gate as recited in claim 1, wherein said bottom slam bolt assembly includes:

a) said sill of said gate frame having a socket therein;

b) a sleeve affixed into said bottom end of said lock stile of said second protective shutter; and c) a bottom spring biased slide bolt carried within said sleeve to normally extend outwardly from said sleeve, so as to enter said socket in said sill.

6. An easy out fire escape window gate as recited in claim 1, further including a frame extender consisting of:

member;

b) a first arm affixed at one end and at a right angle to a lower end of said channel member, to slide fit into an open end of said sill of said gate frame; and c) a second arm affixed at one end and at a right angle to an upper end of said channel member, to slide fit into an open end of said lintel of said gate frame.

* * * * *